United States Patent [19]

Beales

[11] 4,281,721

[45] Aug. 4, 1981

[54] BULLDOZER BLADE MOUNTING ASSEMBLY

[75] Inventor: John H. Beales, Langley, Canada

[73] Assignee: Beales Steel Products Ltd., Langley, Canada

[21] Appl. No.: 968,685

[22] Filed: Dec. 12, 1978

[51] Int. Cl.[3] ..... E02F 3/76

[52] U.S. Cl. ..... 172/821

[58] Field of Search ..... 172/801, 803, 804, 805, 172/807, 809

[56] References Cited

U.S. PATENT DOCUMENTS

| | | | |
|---|---|---|---|
| 2,308,535 | 1/1943 | Paulsen | 172/804 |
| 2,753,638 | 7/1956 | Mork | 172/803 |
| 2,839,848 | 6/1958 | Mackey | 172/804 |
| 3,084,461 | 4/1963 | Beckford | 172/805 |
| 3,631,930 | 1/1972 | Peterson | 172/804 |
| 3,653,451 | 4/1972 | Fryrear | 172/804 |
| 3,670,825 | 6/1972 | Asal | 172/804 |
| 3,690,386 | 9/1972 | Magee | 172/804 |
| 3,780,813 | 12/1973 | Davis | 172/801 |
| 3,795,280 | 3/1974 | Casey | 172/804 |
| 3,991,832 | 11/1976 | Cooper | 172/804 |
| 4,013,132 | 3/1977 | Matsuzawa | 172/804 |
| 4,083,414 | 4/1978 | Yokoyama | 172/804 |

OTHER PUBLICATIONS

Model 850B Crawler Tractor Parts Catalog pp. 259–261 of J.I. Case Racine Wi. 6/1977.

*Primary Examiner*—Richard J. Johnson
*Attorney, Agent, or Firm*—Klarquist, Sparkman, Campbell, Leigh, Hall & Whinston

[57] ABSTRACT

A mounting assembly for supporting a scraping tool (e.g. a bulldozer blade) forward of a vehicle (e.g. a bulldozer) and enabling independent angling and tilting of the tool is disclosed. The assembly includes a U-shaped mainframe, a swingframe, means for pivotally connecting the swingframe to the mainframe, means for pivotally connecting the tool to the swingframe, tilt actuator means interconnecting the mainframe and the scraping tool for rotating the scraping tool in relation to the swingframe about a tilting axis of rotation, and angle actuator means interconnecting the mainframe and the swingframe for rotating the swingframe and scraping tool in relation to the mainframe about an angling axis of rotation.

17 Claims, 5 Drawing Figures

BULLDOZER BLADE

This invention relates to apparatus for supporting a scraping tool such as a bulldozer blade in advance of a vehicle such as a bulldozer.

Typically, a bulldozer blade is supported forward of a U-shaped mainframe which comprises a forward end extending between parallel spaced side arm members or struts pivotally connected to the vehicle on opposite sides thereof. Actuation means interconnecting the mainframe and the vehicle enables rotation of the mainframe about a horizontal axis through the pivotal connecting locations thereby lifting or lowering the forward end of the mainframe and the blade connected thereto.

In addition to lifting and lowering the blade, it is often desirable to control blade angle and/or blade tilt in relation to the mainframe (and necessarily in relation to the vehicle). Herein, the term "blade tilt" refers to the angle of rotation of the blade about an axis in a plane parallel or approximately parallel to the plane of the mainframe, and the term "blade angle" refers to the angle of rotation of the blade about an axis which is perpendicular or approximately perpendicular to the plane of the mainframe. The terms "blade angle" and "blade tilt" should not be confused with the term "blade pitch", the latter of which refers to the angle of rotation of the blade about a transverse axis of the blade.

There are a variety of known structures and mechanisms for mounting bulldozer blades in advance of vehicles in a manner which permits control of blade angle and blade tilt. Examples of such structures and mechanisms are disclosed in U.S. Pat. No. 3,084,461 (Beckford), granted on Apr. 9, 1963; U.S. Pat. No. 3,631,930 (Peterson), granted on Jan. 4, 1972; and U.S. Pat. No. 3,690,386 (Magee), granted on Sept. 12, 1972.

The patent to Beckford discloses a mounting assembly for supporting a blade attachment for both blade angling and blade tilting. The blade attachment is pivotally mounted to an intermediate or support frame which is in turn mounted to the forward end of a U-shaped mainframe. Beckford teaches that the pivotal mounting means interconnecting the blade attachment and the support frame (which means is shown as comprising a pivot pin longitudinally aligned on a tilting axis of rotation) be below the pivotal mounting means interconnecting the support frame and the mainframe, the latter of which includes a pivot pin longitudinally aligned on an angling axis of rotation. Blade tilting is accomplished by actuator or motor means interconnecting the support frame and the blade attachment, and blade angling is accomplished by actuator or motor means interconnecting the mainframe and the support frame. The actuator or motor means for blade tilting is shown as a hydraulic motor connected between two support brackets spaced on opposite sides of the tilting axis of rotation; one of the support brackets being mounted on the support frame, the other of the support brackets being mounted on the blade attachment. The support frame remains in fixed relation to the mainframe when the blade attachment is tilted in relation to the support frame. The actuator or motor means for blade angling is shown as a pair of hydraulic motors extending from and substantially parallel to the side arm members of the mainframe and forwardly thereof to locations positioned low on the back of the blade attachment.

A disadvantage of the Beckford arrangment is that impacts at the extremities of the blade attachment which tend to force the blade attachment away from a fixed tilt position will be transmitted to the pivot pin on the angling axis of rotation. Undesirable stresses may therefore be imposed on this pivot pin and may eventually lead to failure of the pin. A further disadvantage of the Beckford arrangement is that it requires a relatively large support frame in order to support the hydraulic motor for blade tilting relatively far away from the tilting axis of rotation and thereby maximize the torque which can be generated by the motor relative to the tilting axis.

The patent to Magee discloses a blade attachment mounted directly to a mainframe for both blade angling and blade tilting. There is no intermediate or support frame as in the case of the patent to Beckford. Magee shows a blade attachment mounted to the mainframe by means which includes a large ball and socket universal joint supported on a pedestal fixed to the forward end of the mainframe such that the blade tilting axis is relatively high above the cutting edge of the blade attachment. (In the Beckford arrangement, the tilting axis is relatively low above the cutting edge of the blade attachment.) Opposite lower corners of the blade attachment of Magee are connected to the mainframe by a pair of parallel links extending to respective side arm members of the mainframe. Angling of the blade attachment is accomplished by moving one link forwardly and drawing the other link rearwardly thereby causing rotation about an axis through the ball and socket universal joint. Tilting is accomplished by a hydraulic motor connected between a central location on the forward end of the mainframe below the ball and socket universal joint and the back of the blade attachment at a location towards one side thereof.

A disadvantage of the Magee arrangement is that blade angling and blade tilting are not independent—changes in blade angle will occur with changes in blade tilt. This can be significant from an operational point of view because the blade may not get sufficient bite if the blade angle is too shallow; if the blade angle is too deep, the vehicle will tend to drive itself into the ground. The ball and socket universal joint used by Magee is undesirable. It will ordinarily be exposed to relatively high forces and stresses and as such will be a relatively large, expensive element. Further, at the very least, it would be awkward to adapt the Magee arrangement as an "inside mount" arrangement. The structure shown by Magee is an "outside mount" arrangement; that is, an arrangement wherein the side arm members or struts of the mainframe are normally disposed on either side of the bulldozer vehicle outside the vehicle tracks. In some cases, it is desirable to avoid the use of such mounting assemblies which in effect increase vehicle width. Increased width may limit the areas in which the vehicle can operate, and may restrict the ease with which the vehicle can be transported from one operating location to another, as for example on a flat-bed truck.

The patent to Peterson is similar to the patent to Magee in that there is no intermediate support frame as in the case of the patent to Beckford. Again, a large ball and socket universal joint is used to pivotally support a blade on a mainframe for both blade angling and blade tilting. However, in contrast to Magee, the ball and socket universal joint is not supported on a pedestal assembly but extends from the lower front-end of the mainframe to a central location low on the back of the blade. Support is also provided by a pair of "angling" hydraulic motors extending forwardly and upwardly from opposed side arm members of the mainframe to support members located high on the back of the blade and near the sides thereof. Counteracting control of the pair of hydraulic motors will cause the blade to angle, but will also cause the blade to tilt. To adjust blade tilt, Peterson provides a hydraulic motor which extends between a support member located near the top of a pedestal assembly centrally disposed on the forward end of the mainframe and a support member located high on the back of the blade and towards one side thereof.

The fact that blade tilting and blade angling are not independent in the Peterson arrangement is disadvantageous. Also, similar to the case with Magee, the use of a large ball and socket universal joint is undesirable. Further, the structural arrangement shown by Peterson wherein there is a triangular three point mounting of the blade to the mainframe is structurally weak. (viz. The universal ball and socket joint is at the lower apex of an inverted isosceles triangle. The support members to which the "angling" hydraulic motors connect on the back of the blade are at corners of the base of the inverted triangle.) Peterson places support members high on the back of the blade through a desire to maximize moments of force which affect blade pitch, but in doing so lessens the ability of the mounting assembly to support the blade when the blade is subjected to impacts or forces at its base and which may tend to warp or twist the blade especially when the forces or impacts occur at the lower extremities of the blade.

Other examples of structures and mechanisms for mounting bulldozer blades in advance of vehicles in a manner which permits control of blade angle and blade tilt may be found in U.S. Pat. No. 4,013,132 (Matsuzawa), granted on Mar. 22, 1977; and U.S. Pat. No. 4,083,414 (Yokoyama et al), granted on Apr. 11, 1978.

An object of the present invention is to provide a new and improved mounting assembly for supporting a scraping tool, such as a bulldozer blade, forward of a vehicle such as a bulldozer, which permits independent angling and tilting of the scraping tool in relation to a mainframe of the assembly without affecting blade pitch. As part of this objective, it is desired to provide an assembly in which relatively simple pivotal connection means may be utilized which does not require use of ball and socket joints, and which is structured so as to lessen stresses imposed on pivotal connection means on the angling axis of rotation as a result of impact on the scraping tool which tends to rotate the tool from a fixed or desired angle of tilt.

A further object of the present invention is to provide a mounting assembly which can be readily designed as an "inside mount" or as an "outside mount" mounting assembly.

In accordance with the present invention, there is provided a mounting assembly for supporting a scraping tool forward of a vehicle so that the scraping tool can be angled and tilted in relation to a mainframe of the mounting assembly. Although it is contemplated that in most cases the vehicle will be a bulldozer, and the scraping tool will be a bulldozer blade, it will be readily apparent upon consideration of the following disclosure, that the vehicle obviously does not need to be a "bulldozer" and the scraping tool obviously does not need to be a "bulldozer blade".

The assembly is of the type which includes an intermediate or support frame (hereinafter referred to as a "swingframe") disposed between the mainframe and the scraping tool. The swingframe is pivotally interconnected with the forward end of the mainframe in a location generally forward of the mainframe by "first" pivotal connection means which enables limited pivotal rotation of the swingframe in relation to an angling axis of rotation which extends upwardly through the forward end substantially equidistant from side arm members of the mainframe. The pivotal connection means includes a pivot pin extending through the forward end of the mainframe longitudinally along the angling axis.

The scraping tool is pivotally interconnected with the swingframe in a location forward of the swingframe by "second" pivotal connection means which enables limited pivotal rotation of the scraping tool in relation to a tilting axis of rotation extending in a plane substantially transverse to the angling axis of rotation. The second pivotal connection means includes a pivot pin extending longitudinally along the tilting axis between the swingframe and the scraping tool, the tilting axis intersecting the scraping tool at a location centrally disposed widthwise of the tool.

The mounting assembly also includes support means for supporting the scraping tool in spaced relation with the swingframe while permitting limited rotation of the scraping tool in relation to the swingframe about the tilting axis. In a preferred embodiment, the support means includes a pair of arcuate guide channels fixed on the scraping tool for receiving and slidingly holding corresponding arcuate end regions of sides of the swingframe, the arcuate end regions being radially equidistant from the tilting axis of rotation.

The mounting assembly further includes a tilt actuator means (preferably a hydraulic motor means) interconnecting the mainframe and the scraping tool for rotating the scraping tool in relation to the swingframe about the tilting axis. This actuator means has a line of action between first and second ends thereof, the first end being pivotally supported at a location fixed in relation to the mainframe, the second end being pivotally supported at a location fixed in relation to the scraping tool disposed towards one side of the tool. The first end of the tilt actuator means is supported away from the tilting axis substantially on the angling axis of rotation as, for example, by a pedestal means centrally disposed widthwise of the front end of the mainframe and extending upwardly therefrom. Preferably, the line of action of the tilt actuator means extends in a notional plane lying substantially transverse to the tilting axis. It is considered advantageous to interconnect the first actuator means between the mainframe and the scraping tool, rather than between the swingframe and the scraping tool, because the arrangement permits external forces tending to tilt the scraping tool from a fixed or desired angle of tilt, and resulting bending moments, to be transmitted to the mainframe and not to the pivot pin on the angling axis of rotation.

In addition, the mounting assembly of the present invention includes angle actuator means interconnecting the mainframe and the swingframe for rotating the swingframe and necessarily the scraping tool in relation to the mainframe about the angling axis. Preferably, the angle actuator means comprises a pair of actuator means (preferably, a pair of hydraulic motor means) each having a first end and a second end, the first ends being pivotally supported at respective locations fixed in relation to the mainframe on opposite sides of and equidistant from a notional plane containing the angling axis and equidistant from the side arm members of the mainframe, the second ends being pivotally supported at respective locations fixed in relation to the swingframe on opposite sides of and equidistant from a notional plane containing the angling axis and the tilting axis.

In the preferred embodiment where the angle actuator means comprises a pair of actuator means, the first ends of the actuator means may be disposed inwardly from the side arm members of the mainframe, and the second ends may be disposed outwardly in relation to the side arm members of the mainframe. As such, the lines of action of the two actuator means between their first and second ends angle outwardly at a substantial angle from the mainframe to the swingframe. To a degree, such outwardly angled lines of action reduce the maximum torque which may be generated about the angling axis (as compared to the higher maximum torque which could be generated if the angles of the lines of action were lessened by running the first ends to support locations on the side arm members), however, certain advantages follow. Firstly, the absence of interconnection between the swingframe or scraping tool and the side arms readily permits the actuator means for lifting and lowering the front end of the mainframe to be connected at locations on the side arm members which are advanced towards the front end of the mainframe, and this is true for both inside mount and outside mount mainframes. Secondly, the extent to which the actuator means must extend or retract (viz. the stroke) to achieve a desired rotation about the angling axis is lessened.

It is characteristic of the present invention that the pivot pin on the angling axis of rotation is not subjected to undue stress as a result of impacts on the blade tending to tilt the blade from a fixed or desired angle of tilt. Instead, any such impacts will be transmitted to and taken up by the actuator means interconnecting the scraping tool and the mainframe. At the same time, angling and tilting of the scraping tool are independent.

The invention will now be described with respect to a preferred embodiment with reference to the drawings in which.

Figure 1:
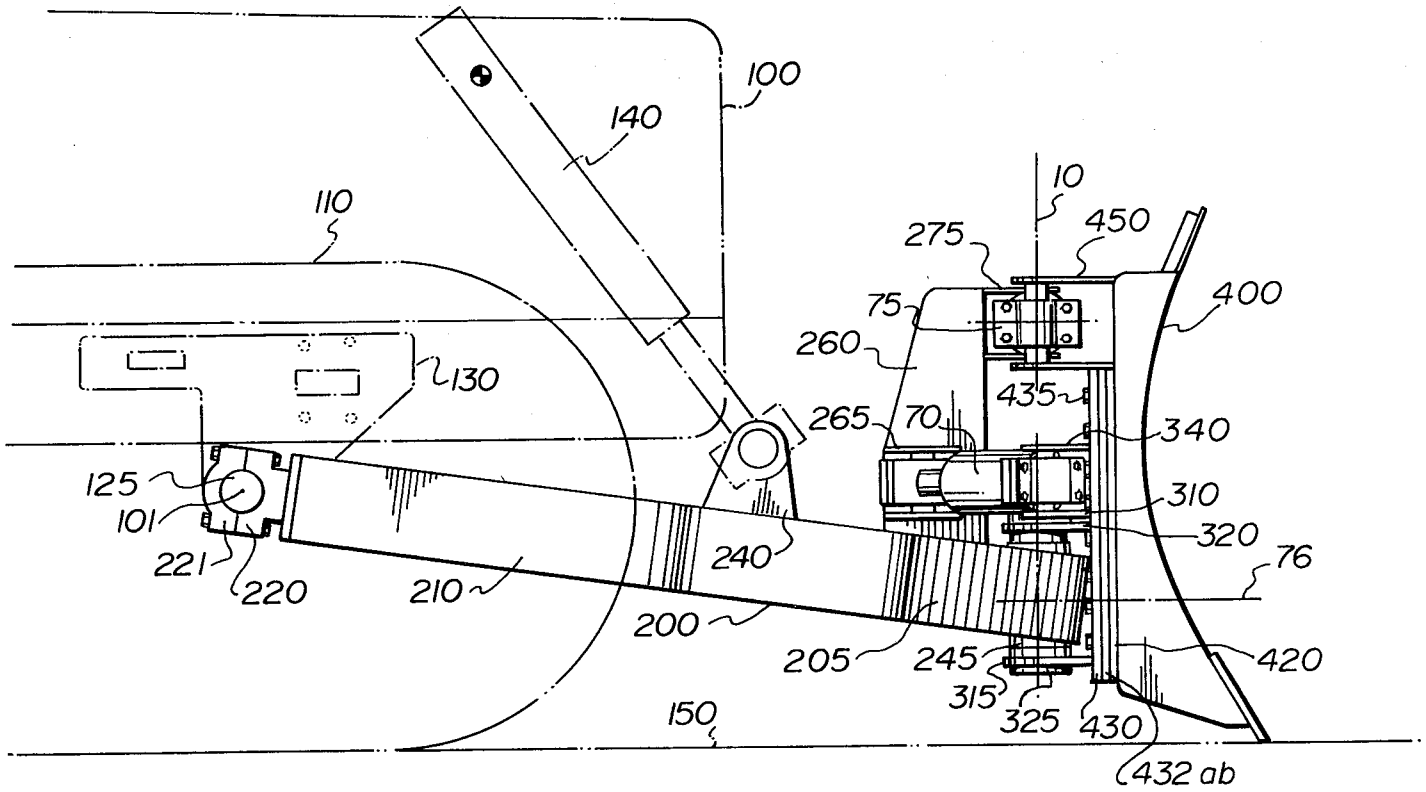
FIG. 1 is a plan view of a mounting assembly for supporting a bulldozer blade forward of a bulldozer, a part of a bulldozer and the ground on which it travels being depicted schematically by broken lines.
Figure 2:
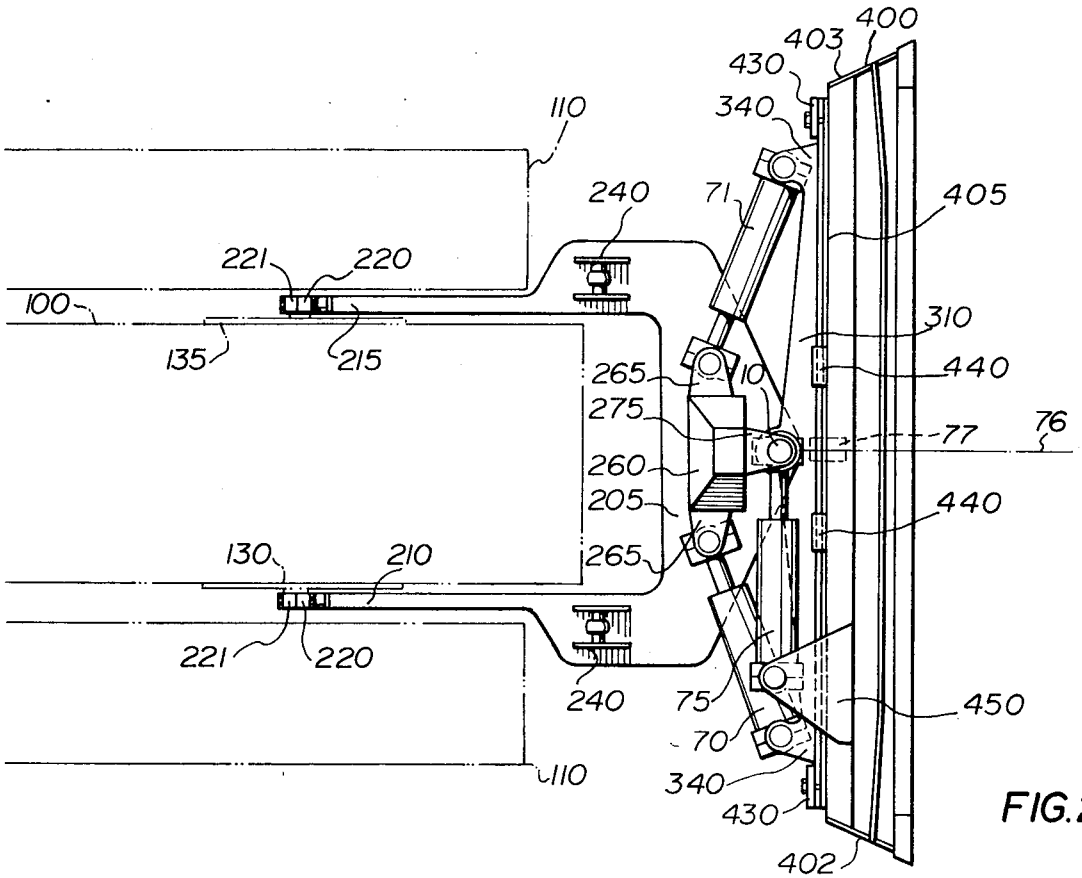
FIG. 2 is a top view of the mounting assembly of FIG. 1.

The mounting assembly shown in FIGS. 1 to 5 is for supporting a bulldozer blade (generally designated 400) forward of a bulldozer in a manner which enables both blade angling and blade tilting. In FIGS. 1 and 2, a schematic outline of the forward part of a bulldozer (generally designated 100) has been included merely to illustrate the usual relationship between the mounting assembly and a bulldozer when the two are interconnected.

The assembly comprises a U-shaped mainframe 200 and a swingframe 300 which is normally pivotally connected to the mainframe at a location generally forward of the mainframe, as is described in more detail hereinafter. As is also described in more detail hereinafter, blade 400 is normally pivotally connected to the swingframe at a location forward of the swingframe.

Mainframe 200 includes a forward end 205 extending between two parallel side arm members or mounting struts 210, 215. The mainframe is an "inside mount" type of mainframe in that struts 210, 215 are normally disposed interior to tracks 110 of bulldozer 100 (see FIG. 2).

To pivotally connect mainframe 200 to bulldozer 100, a trunnion cap and bearing assembly is provided at the end of each strut 210, 215 opposite to forward end 205 of the mainframe. Each cap and bearing assembly includes a trunnion bearing 220 and corresponding trunnion cap 221. The trunnion caps 221 are readily removable from the bearings to permit easy mounting and dismounting of struts 210, 215 on trunnion balls 125 (shown in broken lines in FIG. 3) carried by trunnion plates 130, 135 (also shown in broken lines in FIG. 3). Trunnion plates 130, 135 are normally rigidly attached to bulldozer 100 on opposite sides of the bulldozer frame.

Mainframe 200 includes on each strut 210, 215 a ball joint generally designated 240. Ball joints 240, are for providing pivotal support on the mainframe for hydraulic motors interconnected between the mainframe and the bulldozer. There are a pair of such hydraulic motors, one on either side of the bulldozer body, but only one is shown in broken lines in one of the drawings (viz. hydraulic motor 140 in FIG. 1 pivotally connecting with ball joint 240 on strut 210). By means not shown, but readily understood by those skilled in the art, simultaneous actuation of the hydraulic motors interconnecting the mainframe and the bulldozer will exert a raising or lowering force on ball joints 240 for causing rotation of mainframe 200 about horizontal axis of rotation 101. Hence, forward end 205 and attachments thereto will raise or lower.

The particular means by which a mainframe is connected to a bulldozer, and the means by which it may be raised or lowered in relation to the bulldozer is not considered to be a part of the invention per se. Because there are a variety of well known means for achieving such connection and for causing raising and lowering of the mainframe, no particular detail is shown herein. Also, although it may be generally desirable that a mainframe be pivotally connected to a bulldozer, it is recognized that in some cases the mainframe may be rigidly connected to the bulldozer and as such, not capable of being pivoted about an axis such as axis 101. In such cases, there would of course be no need for pivotal supports such as ball joints 240.

In FIG. 1, it will be observed that the plane of mainframe 200 is angled upwardly from right to left such that the bottom of blade 400 rests on flat ground level 150, and that the blade itself is neither angled or tilted. This may be considered as an overall neutral position. In this position, an angling axis of rotation 10 extends substantially perpendicular to the plane of flat ground level 150 and a tilting axis of rotation 76 extends substantially parallel to flat ground level 150. In relation to the mainframe, the angling axis of rotation is approximately perpendicular to the plane of the mainframe (but deviates from the perpendicular to the extent that the plane of the mainframe, in the said neutral position, angles upwardly in relation to flat ground level 150); and the tilting axis of rotation is in a plane approximately parallel to the plane of the mainframe (but deviates from the parallel to the extent that the plane of the mainframe, in the said neutral position, angles upwardly in relation to flat ground level 150). If blade 400 is lifted upwardly from the position shown in FIG. 1 by rotation of the mainframe about axis 101, then of course the relationship between angling and tilting axes 10, 76 with respect to flat ground level 150 will correspondingly change, but will remain constant with respect to the plane of the mainframe.

A tubular member 245 carrying a cylindrical bushing 250 extends upwardly through and is fixedly carried by forward end 205 of mainframe 200, substantially equidistant from struts 210, 215 of the mainframe. The longitudinal axis of tubular member 245 and bushing 250 coincides with angling axis 10 and, as may be best seen in FIG. 1, therefore angles slightly from the perpendicular in relation to the plane of mainframe 200.

Swingframe 300, comprising a flat plate member 305 with support plates 310, 315 extending rearwardly therefrom is pivotally connected to mainframe 200 by first positioning axially aligned tubular locating members or bearing supports 320, 325 above and below tubular member 245 and bushing 250 in front end 205 of the mainframe. Bearing supports 320, 325 are fixedly carried by support plates 310, 315, respectively. As can be best seen in FIGS. 4 and 5, the longitudinal axes of these bearing supports are in vertical alignment coinciding with angling axis 10. The lower face of bearing support 320 is spaced apart from the upper face of bearing support 325 so that tubular member 245 and bushing 250 may be slidingly received between the bearing supports. The inside diameter of bearing supports 320, 325 is substantially the same as the inside diameter of bushing 250; the outside diameter of the bearing supports is substantially the same as the outside diameter of tubular member 245. When bearing supports 320, 325 are positioned above and below tubular member 245 and bushing 250 such that the longitudinal axes of the bearing supports, tubular member and bushing coincide, then pivot pin 50 is slidingly inserted into the cylindrical channel defined by bearing supports 320, 325 and bushing 250, thereby restricting relative movement between swingframe 300 and mainframe 200 to rotation about angling axis 10. Pin 50 is keyed in this position by a bolt 55 inserted horizontally through bearing support 320 and the upper end of pin 50.

Swingframe 300 also includes a pair of ball joints 340 disposed on opposite sides of plate member 305 substantially equidistant from angling axis 10. Each ball joint 340 is for providing pivotal support on swingframe 300, for one end of one of a pair of hydraulic motors 70, 71. The opposite ends of motors 70, 71 are normally pivotally supported by ball joints 265 disposed on opposite sides of pedestal assembly 260 slightly above front end 205 of mainframe 200. Pedestal assembly 260 is centrally disposed on front end 205, and ball joints 265 lie substantially equidistant from angling axis 10.

Referring to FIG. 2, it will be readily apparent that the ends of hydraulic motors 70, 71 connected to ball joints 265 are pivotally supported at respective locations fixed in relation to the mainframe on opposite sides of and equidistant from a notional plane containing angling axis 10 and equidistant from struts 210, 215 (the notional plane would of course appear as a line in FIG. 2 if it were shown). Similarly, it will be readily apparent that the ends of hydraulic motors 70, 71 connected to ball joints 340 are pivotally supported at respective locations fixed in relation to the swingframe on opposite sides of and equidistant from a notional plane containing angling axis 10 and tilting axis 76.

A pair of stop blocks 370 is provided on the back face of plate member 305. These stop blocks operate to engage mainframe 200 (viz. on the leading face of forward end 205) thereby limiting the maximum clockwise or anticlockwise rotation of swingframe 300 about angling axis 10 to just as the full stroke (retracted or extended) of motor 70 or 71, as the case may be (depending upon direction of angling), is reached.

To enable pivotal interconnection between swingframe 300 and blade 400, a pivot pin 77 rigidly interconnects with plate member 305 and is centrally disposed between opposite sides thereof. Pivot pin 77 extends forwardly from plate member 305, its longitudinal axis coinciding with tilting axis 76.

Figure 4:
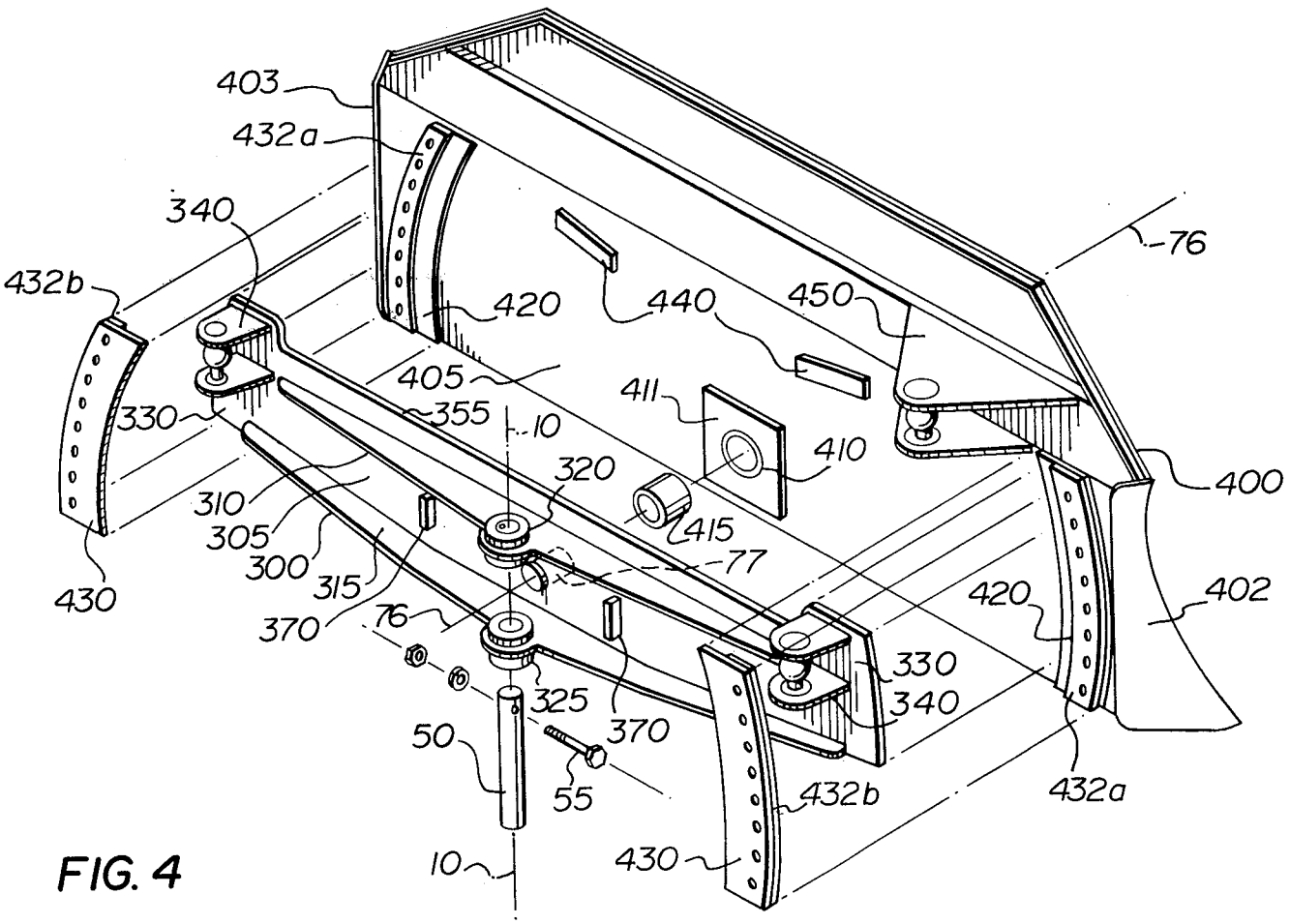
FIG. 4 is a partially exploded perspective view of the swingframe and blade portions of the mounting assembly of FIG. 1.

Blade 400 has a generally familiar overall shape and configuration, but is adapted in particular respects for pivotal connection with swingframe 300. As best shown in FIG. 4, blade 400 includes a centre tube 410 carrying a bushing 415, the longitudinal axes of which coincide with tilting axis 76. Centre tube 410 extends into back face 405 of blade 400 at a location near the bottom of the blade and centrally disposed between opposed sides 402, 403 of the blade. Tube 410 is held in position by rectangular wear plate 411 which rigidly connects around the perimeter of the outer end of the tube and flat against back face 405.

As best seen in FIG. 4, a pair of wear plates 420 are attached to back face 405 towards sides 402, 403, respectively, and symmetrically disposed in relation to axis 76. Attached to each wear plate 420 is an arcuate spacer plate **432*a*, the inner radial surface of which is disposed from axis 76 at a radius slightly greater than the outer radius of opposed arcuate end regions 330 of plate member 305 from axis 76**.

Blade 400 is pivotally connected to swingframe 300 by slidingly moving pivot pin 77 into bushing 415 in centre tube 410 such that the front face of plate member 305 comes substantially flush with the rearwardly exposed face of wear plate 411, and such that arcuate end regions 330 of plate member 305 come substantially flush with the rearwardly exposed faces of wear plates 420. Then, retaining plate 430 and arcuate shims **432*b*, are rigidly attached to wear plates 420 and spacer plates 432*a* by pluralities of bolts 435. Wear plates 420 and spacer plates 432*a* are threaded to receive threaded ends of the bolts. Corresponding holes extending through retaining plates 430 and shims 432*b* for receiving the bolts are not threaded. When the retaining assemblies are bolted in position as aforesaid, retaining plates 430 overlie end regions 330 of plate 305. The complete assembly consisting of wear plates 420 and spacer plates 432*a*, and retaining plates 430 and shims 432*b*, together form a pair of opposed arcuate guide channels for receiving and slidingly holding arcuate end regions 330 of swingframe 300 and which support blade 400 in spaced alignment with the swingframe while permitting limited rotation of the blade in relation to the swingframe about tilting axis 76**.

Figure 5:
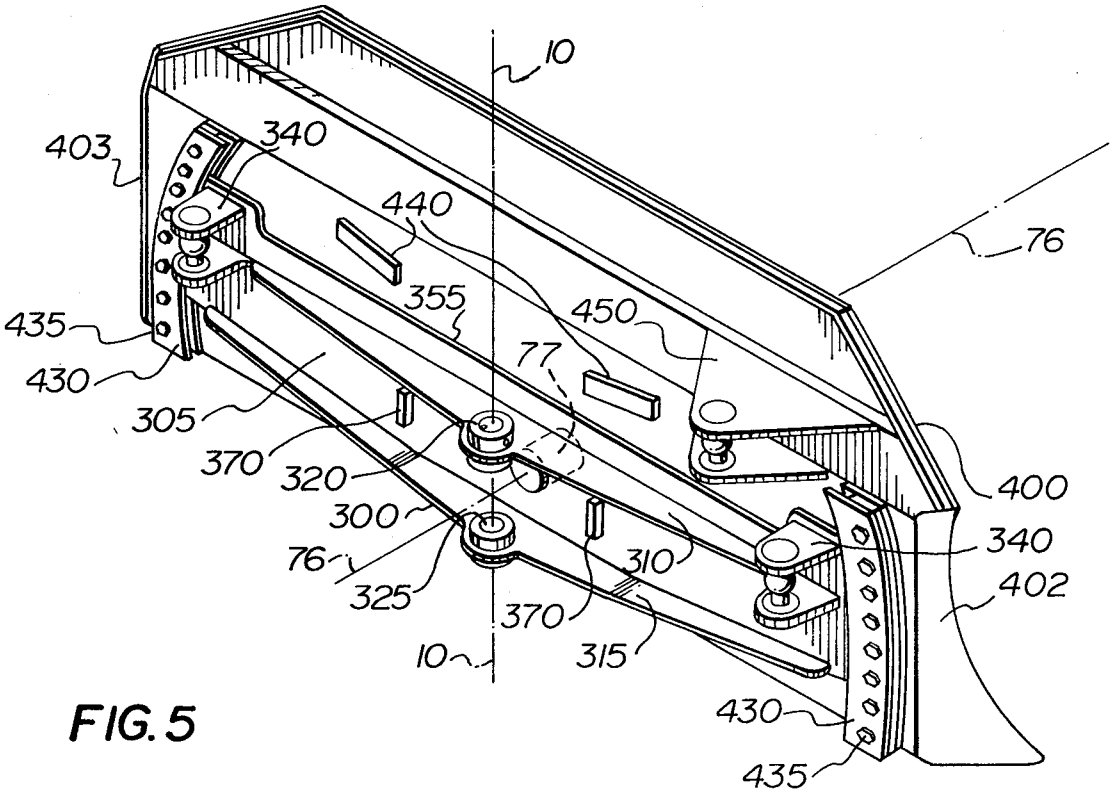
FIG. 5 is a perspective view of the swingframe and blade portions of the mounting assembly of FIG. 1 shown in assembled condition.

Blade 400 and swingframe 300 are best shown in assembled condition in FIG. 5. In FIG. 1, the assembled combination of spacer plate **432*a* and shim 432*b* is designated 432*ab***.

Blade 400 also includes a ball joint 450 disposed relatively high on its back face 405 and offset towards side 402 of the blade. Ball joint 450 is for providing pivotal support for one end of hydraulic motor 75, the other end of which motor is pivotally supported by ball joint 275 centrally disposed on the front of pedestal assembly 260. Ball joint 275 is disposed substantially on angling axis 10 above tilting axis 76. Generally, the greater the perpendicular distance from a line between ball joint 450 and ball joint 275 (viz. the line of action of hydraulic motor 75) to tilting axis 76, the greater the torque which can be developed by motor 75 about axis 76. It is also to be noted (best seen in FIG. 2) that hydraulic motor 75 extends from ball joint 275 to ball joint 450 substantially parallel to back face 405 of blade 400. As such, hydraulic motor 75 has a line of action extending in a notional plane lying substantially transverse to tilting axis 76. This remains true regardless of blade angle. It would be undesirable to have hydraulic motor 75 extend between ball joint 275 and ball joint 450 in some other plane. One consequence would be possible binding of the swingframe in the arcuate guide channels during blade tilting. Then, the action of motor 75 would tend to angle the blade as well as tilt the blade; though this would be resisted by hydraulic motors 70, 71, undesirable stresses may be imposed on the blade.

As may be best seen in FIGS. 4 and 5, a pair of stop blocks 440 is provided on back face 405 of blade 400. These stop blocks operate to engage upper edge 355 of plate member 305 thereby limiting the maximum clockwise or anticlockwise rotation of blade 400 about tilting axis 76 to just as the full stroke (retracted or extended) of motor 75 is reached.

As will be readily apparent to those skilled in the art, angling and tilting of blade 400 is controlled by appropriate actuation of hydraulic motors 70, 71 and 75.

Referring to FIG. 2, to angle swingframe 300 and blade 400 clockwise from the position shown about angling axis 10, hydraulic motor 71 is extended and hydraulic motor 70 is simultaneously retracted. Conversely, to angle the swingframe and blade anticlockwise from the position shown, hydraulic motor 71 is retracted and hydraulic motor 70 is simultaneously extended. As discussed above, maximum clockwise or anticlockwise rotation about angling axis 10 is limited by stop blocks 370. The hydraulic controls and means for operating hydraulic motors in this manner are not shown, but are common and well understood by those skilled in the art.

Tilting of blade 400 about tilting axis 76 is achieved through actuation of hydraulic motor 75. In the drawings, the motor and blade are shown throughout in a neutral position or zero angle of tilt. In this condition, as best seen in FIG. 1, motor 75 extends generally horizontally (in relation to flat ground level 150) between ball joint 275 on pedestal assembly 260 and ball joint 450 on blade 400. Its line of action, as well as extending in a notional plane lying substantially transverse to tilting axis 76, also extends in a notional plane lying substantially transverse to angling axis 10. When motor 75 is extended from the neutral position, blade 400 (guided by the arcuate guide channels as discussed above) will rotate about axis 76 such that side 402 of the blade moves generally downwardly and side 403 correspondingly moves generally upwardly (clockwise about axis 76 in FIGS. 4 and 5). The end of motor 75 supported at ball joint 450 will necessarily move downwardly. The rotation of blade 400 may be continued until upper edge 355 of plate member 305 engages the stop block 440 disposed towards side 402 of the blade. Conversely, when motor 75 is retracted from the neutral position, blade 400 (guided as aforesaid) will rotate about axis 76 such that side 402 of the blade moves generally upwardly and side 403 moves correspondingly generally downwardly—or anticlockwise in FIGS. 4 and 5. In this case, the end of motor 75 supported at ball joint 450 will necessarily move upwardly. Such rotation may be continued until upper edge 355 of plate member 305 engages the stop block 440 disposed towards side 403 of the blade.

The angling and tilting actions are independent and the pitch of the blade is constant relative to the plane of the mainframe at all times. Angling blade 400 in relation to mainframe 200 does not result in changes of blade tilt. Similarly, tilting of blade 400 in relation to mainframe 200 does not result in changes of blade angle.

It is characteristic of the assembly described that pivot pin 50 on angling axis 10 is not exposed to undue stress from impacts tending to rotate blade 400 about tilting axis 76. Shocks from such impacts are substantially absorbed by hydraulic motor 75 and mainframe 200. If motor 75 was interconnected between swingframe 300 and blade 400, then such impacts would be transmitted to pin 50; also, there would be less support between blade 400 and mainframe 200.

Figure 3:
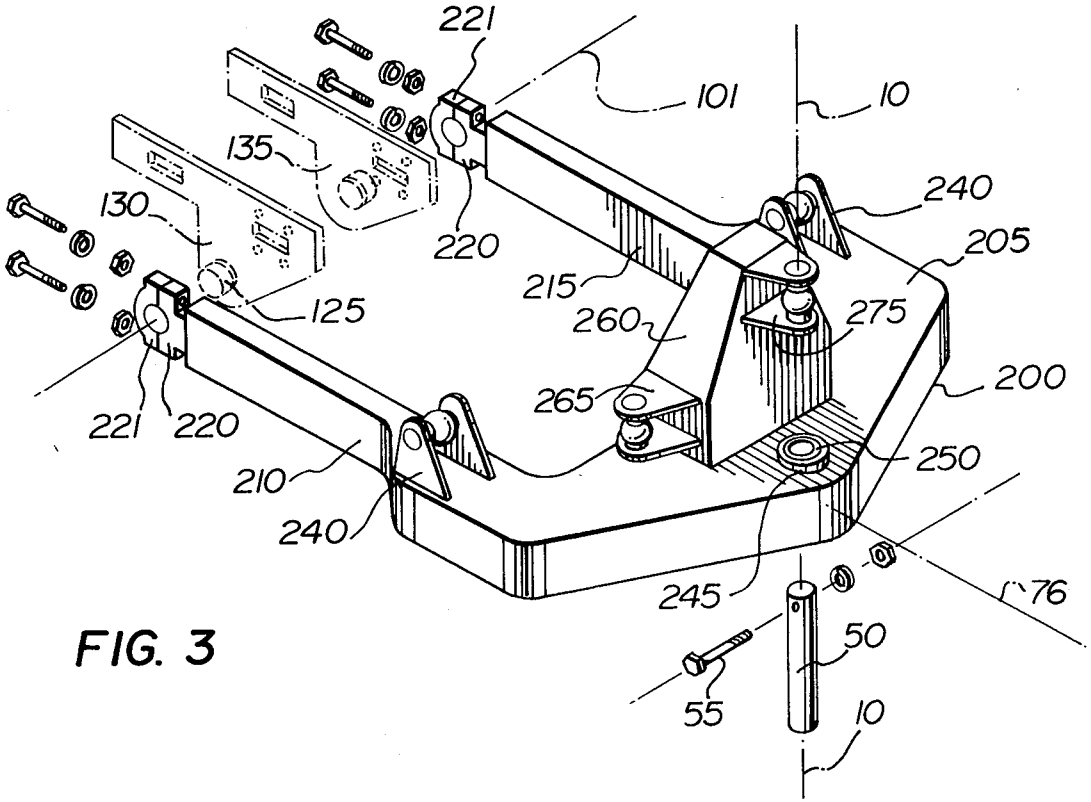
FIG. 3 is a perspective view of the mainframe portion of the mounting assembly of FIG. 1.

In FIGS. 1, 2 and 3 of the drawings, it will be noted that support members 240 are positioned at relatively advanced locations on struts 210, 215. This is desirable to achieve relatively high torque about axis 101 through actuation of hydraulic motors 140. Because support members 265 for hydraulic motors 70, 71 are located on pedestal assembly 260 rather than on struts 210, 215, structural conflict between the blade tilting means and the means for raising and lowering the mainframe is avoided. Further, because the entire blade tilting and blade angling assembly interconnects generally with front end 205 of the mainframe, and does not interconnect anywhere along struts 210, 215, the mounting assembly as a whole may readily be designed as an inside mount or outside mount mounting assembly—for example, for a bulldozer having a given width, the basic difference between an inside mount embodiment and an outside mount embodiment may only be the width of the mainframe.

It is to be understood, however, that hydraulic motors for blade angling could interconnect with support members located elsewhere in relation to a mainframe than on sides of a pedestal. They could, for example, be located on the front end further towards the side arm members or struts of the mainframe, or they could be located on the side arm members or struts themselves. In the embodiment shown in the drawings, support members 265 are disposed away from a notional vertical plane longitudinally bisecting mainframe 200 by a distance less than three-eighths the distance between struts 210, 215, while support members 340 are outwardly disposed on swingframe 300 by a distance greater than one-half the distance between struts 210, 215. The net result is that hydraulic motors 70, 71 extend outwardly from the forward end of mainframe 200 at a significant angle (as can be seen clearly in FIG. 2). The torques which can be developed by hydraulic motors 70, 71 about angling axis 10 are necessarily less than that which would be available if support members 265 were disposed on struts 210, 215, however, the reduction in torque has not presented a problem. Further, the disclosed arrangement permits the advantage that the amount of linear extension or retraction required of motors 70, 71 to achieve a given degree of rotation about angling axis 10 is lessened over that which would be required if support members 265 were disposed on struts 210, 215.

A feature of the embodiment shown in the drawings is that hydraulic motors 70, 71 and 75 are substantially the same in construction, having substantially the same bore and stroke, as are the balls of the ball joints to which they connect. This feature is considered desirable because it lessens the variety of parts required for a complete assembly.

It is contemplated that only one hydraulic motor could be used for angling a blade. For example, hydraulic motor 70 herein could theoretically be replaced by a dummy telescoping support (not shown) which would provide structural support, but not any motive power for blade angling. It would simply retract or extend depending upon actuation of a double-acting hydraulic motor 71.

It is also contemplated that hydraulic motor 75 may not be supported as high above tilting axis 76 as the scale of the drawings would indicate. In an embodiment substantially to the scale of the drawings, more than sufficient torque has been generated by motor 75 indicating that a lower pedestal support 260 could be used (and this would lessen the amount of motor extension or retraction for a given degree of blade tilting).

Although the present invention can find use in various applications, it is considered particularly suitable for use with larger bulldozers encountering strenuous operating conditions.

The preferred embodiment described, contemplates that the tilting axis of rotation intersects the blade or scraping tool near the bottom of the tool, and that the end of the tilt actuator means or hydraulic motor means supported on the angling axis of rotation, be supported above the tilting axis. It is also contemplated that the intersection of the tilting axis and the blade or scraping tool could be higher above the bottom of the tool near the top of the tool, and that the end of the tilt actuator means or hydraulic motor means supported on the angling axis of rotation could be supported below the tilting axis. For example, the swingframe could be pivotally interconnected to the mainframe at the upper end of a pedestal extending upwardly from the front end of a mainframe, and a tilt actuator means connecting with a blade or scraping tool could be pivotally supported at one end on the angling axis of rotation at the level of the front end.

Obvious variations, modifications and departures from the specific assembly described above will readily occur to those skilled in the art without departing from the spirit of the invention and the scope thereof as set forth in the accompanying claims.

I claim:

1. A mounting assembly for supporting a scraping tool forward of a vehicle, said assembly comprising:

(a) a generally U-shaped mainframe comprising a forward end extending transversely between two substantially parallel spaced side arm members;

(b) a swingframe;

(c) first pivotal connection means interconnecting said swingframe to the forward end of said mainframe in a location generally forward on said mainframe for enabling limited pivotal rotation on said swingframe in relation to an angling axis of rotation extending upwardly through said forward end substantially equidistant from said side arm members, said first pivotal connection means including a pivot pin extending through said forward end longitudinally along said angling axis;

(d) second pivotal connection means interconnecting said scraping tool to said swingframe in a location forward of said swingframe for enabling limited pivotal rotation of said scraping tool in relation to a tilting axis of rotation extending in a plane substantially transverse to said angling axis of rotation, said second pivotal connection means including a pivot pin extending longitudinally along said tilting axis between said swingframe and said scraping tool, said tilting axis intersecting said scraping tool at a location centrally disposed widthwise of the tool;

(e) tilt actuator means interconnecting said mainframe and said scraping tool for rotating said scraping tool in relation to said swingframe about said tilting axis, said tilt actuator means having a line of action between first and second ends of said tilt actuator means, said first end being pivotally supported at a location fixed in relation to said mainframe away from said tilting axis and substantially on said angling axis, said second end being pivotally supported at a location fixed in relation to said scraping tool disposed towards one side of said scraping tool;

(f) angle actuator means interconnecting said mainframe and said swingframe for rotating said swingframe and said scraping tool in relation to said mainframe about said angling axis; and (g) support means for supporting said scraping tool in spaced relation with said swingframe while permitting limited rotation of said scraping tool in relation to said swingframe about said tilting axis.

2. A mounting assembly as defined in claim 1, wherein said line of action of said tilt actuator means extends in a notional plane lying substantially transverse to said tilting axis.

3. A mounting assembly as defined in claim 2, wherein:

(a) first and second sides of said swingframe each have an arcuate end region extending radially equidistant from said tilting axis; and, (b) said support means includes a pair of opposed arcuate guide channels fixed on said scraping tool for receiving and slidingly holding said arcuate end regions.

4. A mounting assembly as defined in claim 1, wherein said angle actuator means comprises a pair of actuator means each having a first end and a second end, the first ends being pivotally supported at respective locations fixed in relation to said mainframe on opposite sides of and equidistant from a notional plane containing said angling axis, and equidistant from said side arm members, the second ends being pivotally supported at respective locations fixed in relation to said swingframe on opposite sides of and equidistant from a notional plane containing said angling axis and said tilting axis.

5. A mounting assembly as defined in claim 2, wherein said angle actuator means comprises a pair of actuator means each having a first end and second end, the first ends being pivotally supported at respective locations fixed in relation to said mainframe on opposite sides of and equidistant from a notional plane containing said angling axis and equidistant from said side arm members, the second ends being pivotally supported at respective locations fixed in relation to said swingframe on opposite sides of and equidistant from a notional plane containing said angling axis and said tilting axis.

6. A mounting assembly as defined in claim 3, wherein said angle actuator means comprises a pair of actuator means each having a first end and a second end, the first ends being pivotally supported at respective locations fixed in relation to said mainframe on opposite sides of and equidistant from a notional plane containing said angling axis and equidistant from said side arm members, the second ends being pivotally supported at respective locations fixed in relation to said swingframe on opposite sides of and equidistant from a notional plane containing said angling axis and said tilting axis.

7. A mounting assembly for supporting a bulldozer blade forward of a bulldozer, said assembly comprising:

(a) a generally U-shaped mainframe comprising a forward end extending transversely between two substantially parallel spaced side arm members;

(b) a swingframe;

(c) first pivotal connection means interconnecting said swingframe to the forward end of said mainframe in a location generally forward on said mainframe for enabling limited pivotal rotation of said swingframe in relation to an angling axis of rotation extending upwardly through said forward end substantially equidistant from said side arm members, said first pivotal connection means including a pivot pin extending through said forward end longitudinally along said angling axis;

(d) second pivotal connection means interconnecting said blade to said swingframe in a location forward of said swingframe for enabling limited pivotal rotation of said blade in relation to a tilting axis of rotation extending in a plane substantially transverse to said angling axis of rotation, said second pivotal connection means including a pivot pin extending longitudinally along said tilting axis between said swingframe and said blade, said tilting axis intersecting said blade at a location centrally disposed widthwise of the blade;

(e) first hydraulic motor means interconnecting said mainframe and said blade for rotating said blade in relation to said swingframe about said tilting axis, said first hydraulic motor means having a line of action between first and second ends of said first hydraulic motor means, said first end being pivotally supported at a location fixed in relation to said mainframe away from said tilting axis and substantially on said angling axis, said second end being pivotally supported at a location fixed in relation to said blade disposed towards one side of said blade;

(f) a pair of hydraulic motor means interconnecting said mainframe and respective sides of said swingframe for rotating said swingframe and said blade in relation to said mainframe about said angling axis; and, (g) support means for supporting said blade in spaced relation with said swingframe while permitting limited rotation of said blade in relation to said swingframe about said tilting axis.

8. A mounting assembly as defined in claim 7, wherein:

(a) said tilting axis intersects said blade as aforesaid near the bottom of the blade; and, (b) said first end of said first hydraulic motor means is supported as aforesaid above said tilting axis.

9. A mounting assembly as defined in claim 8, wherein said line of action of said first hydraulic motor means extends in a notional plane lying substantially transverse to said tilting axis.

10. A mounting assembly as defined in claim 9, including pedestal means centrally disposed on the front end of said mainframe and extending upwardly therefrom for supporting said first end of said first hydraulic motor means as aforesaid.

11. A mounting assembly as defined in claim 10, wherein each hydraulic motor means of said pair of hydraulic motor means has a first end and a second end, the first ends being pivotally supported at respective locations fixed in relation to said mainframe on opposite sides of and equidistant from a first notional plane containing said angling axis and equidistant from said side arm members, the second ends being pivotally supported at respective locations fixed in relation to said swingframe on opposite sides of and equidistant from a second notional plane containing said angling axis and said tilting axis.

12. A mounting assembly as defined in claim 11, wherein:

(a) the distance from said first notional plane to said first ends of said pair of hydraulic motor means is less than one-half the distance between said side arm members; and, (b) the distance from said second notional plane to said second ends of said pair of hydraulic motor means is at least one-half the distance between said side arm members.

13. A mounting assembly as defined in claim 11, wherein:

(a) the distance from said first notional plane to said first ends of said pair of hydraulic motor means is less than three-eighths the distance between said side arm members; and, (b) the distance from said second notional plane to said second ends of said pair of hydraulic motor means is greater than one-half the distance between said side arm members.

14. A mounting assembly as defined in claim 13, wherein the first ends of said pair of hydraulic motor means are pivotally supported on opposed sides of said pedestal means slightly above the front end of said mainframe.

15. A mounting assembly as defined in claim 9, wherein the line of action of said first hydraulic motor means extends in a notional plane lying substantially transverse to said angling axis.

16. A mounting assembly as defined in claim 9, wherein said first hydraulic motor means and each hydraulic motor means of said pair of hydraulic motor means all have substantially the same bore and stroke.

17. A mounting assembly as defined in claim 9, wherein:

(a) said respective sides of said swingframe each have an arcuate end region extending radially equidistant from said tilting axis; and, (b) said support means includes a pair of opposed arcuate guide channels fixed on said scraping tool for receiving and slidingly holding said arcuate end regions.

* * * * *